United States Patent [19]

Smith, Jr.

[11] 4,371,449

[45] Feb. 1, 1983

[54] PRODUCT FOR DELINTING COTTONSEED

[75] Inventor: Richard L. Smith, Jr., East Point, Ga.

[73] Assignee: SSC Industries, Inc., East Point, Ga.

[21] Appl. No.: 99,548

[22] Filed: Dec. 3, 1979

Related U.S. Application Data

[62] Division of Ser. No. 4,408, Jan. 18, 1979, Pat. No. 4,216,616.

[51] Int. Cl.[3] ..... C11D 7/08; C11D 1/825

[52] U.S. Cl. ..... 252/142; 252/90; 252/307; 252/548; 19/40

[58] Field of Search ..... 252/142, 307, 548; 19/40; 34/60; 47/58

[56] References Cited

U.S. PATENT DOCUMENTS

| | | | |
|---|---|---|---|
| 340,635 | 4/1886 | Stead | 19/40 |
| 2,618,103 | 11/1952 | Streets | 47/58 |
| 2,831,815 | 4/1958 | Klisch | 252/548 |
| 3,037,887 | 6/1962 | Brenner et al. | 134/22 R |
| 3,436,262 | 4/1969 | Crowe et al. | 134/10 |
| 3,511,784 | 5/1970 | Riggs et al. | 252/148 |
| 3,518,118 | 6/1970 | Farison | 134/3 X |
| 3,639,283 | 2/1972 | Crotty | 252/142 X |
| 4,124,407 | 11/1978 | Binns | 134/3 |
| 4,235,734 | 11/1980 | Scherubel | 252/142 |
| 4,259,764 | 4/1981 | Downing | 19/41 |

FOREIGN PATENT DOCUMENTS

| | | |
|---|---|---|
| 2130877 | 11/1972 | France . |

*Primary Examiner*—P. E. Willis, Jr.

*Attorney, Agent, or Firm*—Newton, Hopkins & Ormsby

[57] ABSTRACT

Sulfuric acid is admixed with a foaming agent to produce a lather which is then mixed with cottonseed to delint the same. The lint is removed in a dry or semi dry condition.

13 Claims, No Drawings

PRODUCT FOR DELINTING COTTONSEED

This is a division of application Ser. No. 004,408, filed Jan. 18, 1979, now U.S. Pat. No. 4,216,616.

BACKGROUND OF THE INVENTION

1. Field of the Invention

This invention relates to the acid delinting of cottonseed and is more particularly concerned with a product for delinting cottonseed.

2. Description of the Prior Art

Cottonseeds, which are the by-product of a cotton ginning operation, are covered with fibrous lint attached to the seeds. This lint causes an agglomeration or clustering of the seeds and prevents the ready mechanical handling of individual seeds in producing oil and meal therefrom, in grading handling and storing the seeds and in mechanically planting the seeds. Thus, two general methods have been developed for removing the lint from the seed. One such process mechanically removes the lint, while the other such process chemically removes the lint.

The mechanical delinting of the cottonseed is usually accomplished by an apparatus employing high speed sharp saws or abrasive surfaces which cut or rub the fibers off of the hull. The advantages of this type of operation is that the fibers are not degraded during the operation and can be sold for various purposes. Also, since the seeds are to be subsequently crushed for oil or meal, the damage sustained by the seeds is not detrimental to their further use. The disadvantages of the mechanical delinting operation is that it requires substantial amounts of power, the maintenance costs are high and the damage caused to the seeds may preclude the use of such seeds for planting purposes. Of primary importance is the fact that under current government regulations in the United States, namely the Cotton Dust Control Standards Act, such plants which mechanically delint may not be able to continue to operate without very material alterations to their quite expensive equipment. U.S. Pat. No. 672,297 typifies the mechanical delinting machinery.

The acid delinting of cottonseed has been extensively used, particularly when the seeds are to be employed for planting purposes. Both sulfuric acid and hydrochloric acid have been respectively used for such acid delinting. In concentrated form however, hydrochloric acid is a gas and has been used for delinting cottonseed. Usually heat is employed to accelerate the chemical reaction and the acid is neutralized with anhydrous ammonia.

The hydrochloric acid method is currently used only in areas where ambient humidity levels are very low. Furthermore, there is a danger of killing the seeds with excess hydrochloric acid and there is the objectionable smell of the ammonia and the corrosion caused by the vapors of hydrochloric acid. Here again, material alterations to the process may be required in order to comply with current clean air standards.

The most accepted procedure for the delinting of cottonseed is the utilization of dilute sulfuric acid which is comingled with the cottonseed. After the delinting operation, the seeds are washed then dried with heat.

In some processes, the seeds are prewet and then the concentrated sulfuric acid added to the mixture of water and cottonseed. At times, anhydrous ammonia is employed for neutralizing the acid left on the seed. U.S. Pat. No. 4,064,636 is typical of the delinting apparatus which employs sulfuric acid and discloses the use of a surfactant with sulfuric acid, the surfactant being used as a wetting agent. Other patents disclosing the acid delinting of cottonseed are: U.S. Pat. No. 249,691; U.S. Pat. No. 310,628; U.S. Pat. No. 340,635; U.S. Pat. No. 344,651; U.S. Pat. No. 400,786; U.S. Pat. No. 307,100; U.S. Pat. No. 297,193; U.S. Pat. No. 13,708; U.S. Pat. No. 71,499; U.S. Pat. No. 299,378; and U.S. Pat. No. 695,305.

In U.S. Pat. No. 2,618,103, a process is disclosed in which the cottonseeds are prewet with water containing a "wetting agent" and dye, the wetting agent being used for better penetration of the water into the seed surfaces. Concentrated sulfuric acid is then added to the wetted seeds for delinting them.

The present invention reduces the amount of acid required for the delinting of the seeds, reduces to a minimum or eliminates wholly the use of external heat for carrying out chemical reaction; eliminates the necessity of using water as a pre-wetting agent on the seeds and reduces to a minimum the requirement for neutralizing the excess acid; facilitates the ready removal of the lint from the seed; provides a lint by-product which is useful and speeds up the time required to remove the lint from the seeds.

SUMMARY OF THE INVENTION

Briefly described, the present invention includes creating a foam or lather preferably having a sulfuric acid concentration of 40% or more by weight, and treating dry cottonseeds containing the lint with this foam, followed by separating the lint from the seeds. The foam is produced by thoroughly mixing the sulfuric acid with a surfactant or foaming agent and a gas, such as air.

The foaming agents include any number of non-ionic surfactant which are essentially non-reactive with sulfuric acid. One group of preferred foaming agents is the ethoxylated alcohols having an alcohol or alcohols with 8 to 18 carbon atoms, the ethoxylated alcohol being obtained as a reaction product from a mixture of alcohol having 8 to 18 carbon atoms and ethylene oxide. Another preferred foaming agent is formed of a fatty amide prepared from coconut oil or coconut fatty acid in admixture with diethanolamine. Mixtures of the aforesaid agents are also particularly useful.

The mixtures of sulfuric acid and surfactant are mechanically foamed to produce a stable lather or foamed using any of a variety of mechanical whipping devices or air sparging devices.

The foamed sulfuric acid and surfactant are progressively admixed with cottonseed either in batch form or in a continuous operation so that the lint is converted to a white powdery substance or a black charred substance, either of which is then readily removed from the seed.

An object of the present invention is to provide a foamed or foamable sulfuric acid product which is suitable for delinting cottonseed without pre-wetting the seeds and without requiring appreciable neutralization.

Other objects, features and advantages of the present invention will become apparent from the following detailed description.

DESCRIPTION OF THE PREFERRED EMBODIMENTS

In more detail, the process here utilized includes mixing strong sulfuric acid having 40% or more, by weight, sulfuric acid and preferably concentrated sulfuric acid containing 80% or more sulfuric acid, with a foaming agent such as a non-ionic surfactant, so as to increase the volume of the sulfuric acid preferably by at least ten times and produce a stable lather or foam which is then progressively added to the top of a stream of agitated cottonseeds which contain lint. The foaming operation for the mixture is carried out by mechanical agitation or by introducing pressurized gas, such as air, into the mixture of sulfuric acid and surfactant or both. Of course, if desired, other gases may be employed for producing the foamed concentrated sulfuric acid. For example, carbon dioxide or nitrogen may be employed for foaming the sulfuric acid.

In the foamed condition the sulfuric acid-foaming agent mixture comprises a cellular mass in which the lamella of each cell is very thin and contains the uniformly dispersed sulfuric acid. The foam usually increases the volume of the mixture from about 10 to about 40 times.

When the lather of strong sulfuric acid is introduced on the top of an agitated mass of cottonseeds containing the lint, the cascading cottonseeds, which may be moving longitudinally progressively along a conveyor-agitator, as discussed later, pick up the concentrated sulfuric acid lather which then migrates inwardly along the linters. Since such lint contains from about four to eight percent moisture, there is a strong dehydrating action of the sulfuric acid in removing the water from the lint. This reaction is exothermic and the heat, thus generated, speeds up the reaction. Therefore, after the sulfuric acid foam and seeds have been comingled and agitated for a time period sufficient for chemical reaction, the lint is reduced. The length of this time period depends upon the concentration of the sulfuric acid, the temperature at which the reaction takes place and may take only a few minutes where the concentration of sulfuric acid is high.

For example, by using 93% $H_2SO_4$ the time required may be as little as one minute.

By foaming the sulfuric acid, the surface area of the sulfuric acid is increased tremendously. Thus, when the foam contacts the seed there is a substantially increased interface area between the linters and the acid which causes a progressive collapse of the lamella of the cells and the deposit of discrete small quantities of acid and surfactant on the linters. The amount of wetting, however, is insufficient to cause a total collapse of the linters to wrap around the seed. However, there is sufficient sulfuric acid available to migrate by capillary action and surface wetting along the linters so that substantially all of the lint is reacted with the sulfuric acid to produce acid degraded cellulose, usually without appreciable excess sulfuric acid being present after the reaction.

In more detail, while any of a number of nonionic surfactants may be employed which will not be degraded by the sulfuric acid, I prefer to use an ethoxylated alcohol or an amide alone or in admixture. Such compounds are quite stable with respect to concentrated sulfuric acid. I employ from about one-eighth percent to about twenty percent by weight of a foaming agent based on the total weight of the mixture; however, it is preferable to use not more than five percent (by weight of the total mixture) of a foaming agent in admixture with the concentrated sulfuric acid.

After being mixed together, the acid and foaming agent are introduced into a foaming machine. Commercial foaming machines are available in the textile and carpet industry for producing foamed latex. Such foaming machines are suitable for use in my process. One such commercial foaming machine is produced by Oakes & Company and another foaming machine is produced by Eze, Inc. of Dalton, Georgia.

Such foaming machines are also used in the textile industry for applying finishing agents to fabrics. Mechanical whipping machines, such as blenders, are also useful in producing a foamed sulfuric acid from the mixture of sulfuric acid and foaming agent.

One suitable foaming agent is an ethoxylated alcohol which is the reaction product of fatty alcohol and ethylene oxide. The alcohol can constitute from about 30% to about 45% by weight of the mixture and the ethylene oxide from about 55% to about 70% by weight of the mixture. The ethoxylated alcohol should contain from 8 to 18 carbon atoms. Preferably a commercial mixture of alcohols containing 10 and 12 carbon atoms is employed. From about 7 to about 12 moles of ethylene oxide per mole of alcohols is employed.

Another surfactant or foaming agent which I have found suitable for my process is a fatty amide which is preferably a reaction product of coconut fatty acid or coconut oil and diethanolamine. The fatty amide can be prepared from any number of amines. However, I prefer diethanolamine because of its foam properties and low cost.

The molar ratio of coconut fatty acid moiety to diethanolamine can vary from about 1:1 to about 1:2.4. I prefer to use one equivalent fatty acid to two equivalents diethanolamine, since this mildly alkaline product is more readily soluble in strong sulfuric acid.

When coconut oil is used, an alkaline catalyst, such as potassium hydroxide, can be used to produce a mixture of amide and aminoester by amidation and transesterification. This mixture is an especially good foam stabilizer.

When reacting the coconut fatty acid and diethanolamine, a temperature of above 120° C. and preferably about 160° C. should be employed. The reaction takes about three (3) to six (6) hours. If the reaction is carried out below about 120° C., an amide soap is produced.

Still a third surfactant can be produced from the ethoxylated alcohol described above in admixture with the fatty amide. This is probably the best surfactant to use in that the alcohol is a good foaming agent while the fatty amide works as a good stabilizer. Such a mixture should contain one part of the fatty amide to one to four parts of ethoxylated alcohol, by weight.

It is best to use a nonionic surfactant as the foaming agent since they are usually not appreciably degraded by the strong acidity action of the sulfuric acid.

In producing the foam, the sulfuric acid and the nonionic surfactant are mixed together, as pointed out above, so that the surfactant constitutes from about 0.12% to about 20%, but preferably not more than 5% by weight of the total mixture. This mixture of sulfuric acid and surfactant is beat or sparged or subjected to a combination of these actions until the volume of the sulfuric acid and surfactant have been increased to ten times or more the normal volume. It is desirable that the volume be increased to fifteen times the original volume. Up to forty times the original volume has been achieved. In operation, from twelve to fifteen times increase in volume is quite acceptable. This produces a stable lather which will exist for an extended period of time. The greater the amount of volume increase, the more desirable is the resulting lather. When the volume increase is approximately ten fold, the foam remains stable for about 30 minutes before collapsing. The more sulfuric acid or the more foaming agent used, the more stable the foam remains.

The seeds may be fed along a horizontal trough in which is disposed a conveyor-agitator such as depicted in U.S. Pat. No. 4,064,636, with the seeds being fed into the trough as illustrated in that patent. Then the prefoamed acid is introduced to the first ¼th or about five feet of the trough. The foam can be introduced through a plurality of small holes in a single pipe extending over the trough, if desired.

Utilizing the process of the present invention, I employ about 10 ccs (18.4 grams) of 93% sulfuric acid (concentrated sulfuric acid) per pound of seed. As low as 6 grams of 93% sulfuric acid per pound of seed has given satisfactory results. If desired, less concentrated sulfuric acid can be employed, such as 40% sulfuric acid. By the term concentrated sulfuric acid, however, I mean sulfuric acid containing 80% or more acid, which has the advantage of adding less water to the seed.

While my process is operable using dilute sulfuric acid, the necessity of perhaps drying the seed and driving off the water which is in admixture with the sulfuric acid dictates that the more desirable procedure is to employ a concentrated sulfuric acid.

The main advantage of the present invention over the prior art procedures which employ dilute sulfuric acid, such as the procedure of U.S. Pat. No. 4,064,636, is that while perhaps the same amount of sulfuric acid may be required to react with the fibers, nevertheless the elimination of the necessity for diluting the sulfuric acid and of driving off the moisture from the wet seeds, after they have been delinted, very materially reduces the cost of delinting cottonseed using the present procedure.

After the delinting has taken place, the seeds and degraded lint are separated. A cyclone separator or simply a screen can be used for moving the white fluffy or black charred degraded cellulose from the seeds. Any other form of dry separation after drying and scrubbing is also suitable. Dry separation is not possible without some drying and buffing of the acid treated seeds.

If the acid treated seeds appear to be in a charred condition or a blackened condition, or if the removed lint or cellulose is in a blackened condition, too much acid has probably been utilized on the seeds. Therefore, the quantity of acid employed should be decreased.

When the seeds are fed along the trough by the conveyor agitator, the rubbing action or scrubbing action of the seeds against each other appears to be sufficient to remove substantially all of the lint from the hull after some drying.

In the laboratory it required only 4 ccs of concentrated sulfuric acid (98% $H_2SO_4$) foamed with a foaming agent to delint one pound of cotton seeds. In runs using the equipment similar to the equipment of U.S. Pat. No. 4,064,636 about 60 pounds of concentrated sulfuric acid per ton of cottonseeds are used.

Degradation of the linters begins as soon as the foamed concentrated sulfuric acid is applied, the sulfuric acid having a strong dehydrating effect on the linters which produces the exothermic reaction raising the temperature at the site of the reaction. Only two or three minutes contact time is required to degrade the linters. However, up to about 10 minutes may be required due to the time required to distribute the acid evenly to the seeds in a trough and to thereafter remove the seeds. If such reaction undergone by the lint eliminates the cotton dust hazard, then the process using a dilute acid foam will do the same.

Cotton dust is eliminated by the surfactant/sulfuric acid combination in the present operation so that the present process complies with the Cotton Dust Standards Act, based on the rules and regulations covering the occupants exposure to cotton dust, promulgated in the Federal Register of June 23, 1978.

It is obvious that when the process here disclosed is used in a conventional plant the foamed acid is substituted in place of the non-foamed dilute or non-foamed concentrated sulfuric acid of the prior art.

From the following specific examples, it will be seen that satisfactory results can be obtained, in a foamed condition, using from about 26.5 pounds to about 105 pounds of sulfuric acid per ton of seeds. Also, the following examples show that from about 80 pounds to about 264 pounds of water per ton of seed is used in producing the foamed sulfuric acid mixture employed.

While it is far better to use a mixture of ethoxylated alcohol and fatty amide as the nonionic surfactant or foaming agent, other ethoxylated compounds such as Tergitol NPX (ethoxylated nonylphenol) or the ethoxylated alcohol alone or the fatty amide alone can be employed.

When 10 grams Tergetol NPX to 90 grams of 30% sulfuric acid were blended in a high speed blender for 30 seconds, it produced a product with 15 times the original volume, however, the structure of the bubbles was very large and stability was low.

When 10 grams of the fatty amide described specifically above was mixed with 90 grams of 80% sulfuric acid and blended in a Waring blender for 30 seconds at high speed, the foam was less than 3 times the volume. The appearance of the foam was very good, the size of the bubbles were small and the appearance of the foam was very dry. The foam stability was also good and it lasted at least 10 minutes.

When 10 grams of the ethoxylated alcohol described specifically above was mixed with 90 grams of 80% sulfuric acid and agitated in the blender for 30 seconds at high speed, the mixture foamed to 4½ volumes; however, the stability was poor and the foam lasted less than three minutes.

Thus, the synergistic effect of the mixture of ethoxylated alcohol and fatty amide which, when mixed with sulfuric acid and foamed, will produce up to 40 volumes and a half life of more than 12 hours, is demonstrated. I do not, however, preclude using the ethoxylated compounds or the fatty acid amides alone or in other mixtures, as foaming agents for sulfuric acid. I prefer, however, to use the mixture.

The acid has sufficient water for wetting and saturating the linters while at the same time being of sufficient concentration for degradation of the linters before they reach the usual drying station.

Other foamed acids such as phosphoric acid and hydrochloric acids have been foamed and applied to cotton seeds by me but neither gave as satisfactory a result as the foamed sulfuric acid here disclosed.

Having generally described the invention, a more complete understanding can be obtained by reference to certain specific examples, which are included for purposes of illustration only and are not intended to limit the invention unless otherwise specified.

EXAMPLE 1

One hundred grams of a liquid containing 40% concentrated (98% sulfuric acid by weight) sulfuric acid, 0.125% by weight preferred foaming agent of ethoxylated alcohol and amide admixed in the ratio of 3:2 and the remainder water were foamed. A portion of the resultant foam was added to undelinted cotton seed in a beaker in the proportion of 12 grams of concentrated sulfuric acid per pound of seed. Practically no reaction appeared to take place at room temperature. The beaker and reactants were next placed in an oven at 220° F. for approximately one hour. Delinting then occurred although the cellulose and seed were blackened.

EXAMPLE 2

The experiment of Example 1 was repeated with the exception that the foam was added in the proportion of only six grams of concentrated sulfuric acid per pound of undelinted seed were used. The results were the same as Example 1.

EXAMPLE 3

One hundred grams of a liquid containing 80% concentrated sulfuric acid by weight, 0.125% by weight preferred foaming agent of ethoxylated alcohol and amide admixed in the ratio of 3:2 and the remainder water were foamed. The foam seemed to be drier than the 40% sulfuric acid foam of Example 1 with smaller bubble size. Foam from such mixture was added to a beaker containing undelinted seed in the proportion of 24 grams of concentrated acid per pound of seed. The beaker and reagents were allowed to sit at room temperature for approximately 30 minutes after which the delinting action was proceeding slowly. The beaker was then placed in an oven at 220° F. for another 30 minutes. Delinting occurred with the cellulose again turning black.

EXAMPLE 4

The experiment of Example 3 was repeated with the exception that foam was added in the proportion of only twelve grams of concentrated sulfuric acid per pound of undelinted seed. Again delinting occurred when the seed and foam were placed in an oven for about 30 minutes at a temperature of 220° F. Again blackening of the cellulose occurred.

EXAMPLE 5

The experiment of Example 4 was repeated with the exception that the seed and foam were left in the oven at 220° F. for only five minutes, with delinting occurring.

EXAMPLE 6

The experiment of Example 4 was repeated with the exception that the seed and foam were left in the oven for 30 minutes at 140° F. with delinting being accomplished.

EXAMPLE 7

One hundred grams of liquid containing 97 grams of 98% sulfuric acid and 3 grams of a foaming agent of ethoxylated alcohol and amide admixed in the ratio of 3:2 were foamed. This 100 grams of liquid product produced about 1800 ccs of foam. A portion of the resultant foam was added to undelinted cottonseed in a beaker in the proportion of 20 grams sulfuric acid per pound of seed. The mixture of seed and foam was constantly stirred at room temperature, and the lint appeared well degraded after approximately five minutes. An individual seed was then studied with the conclusion that the lint was degraded and would scrape easily from the seed.

EXAMPLE 8

The experiment of Example 7 was repeated with the exception that the beaker of treated seed was warmed in an oven at a temperature of 220° F. for about 3 minutes. Warming brought the temperature of the lint to 120° F. Constant stirring removed the lint from the seed.

EXAMPLE 9

One hundred grams of liquid containing 90% sulfuric acid and 10% by weight of the preferred foaming agent of ethoxylated alcohol and amide admixed in a ratio of 3:2 were foamed. This 100 grams of liquid product produced about 2000 ccs of foam. A portion of the resultant foam was added to undelinted cottonseed in a beaker in the proportion of 30 grams of sulfuric acid per pound of seed. Constant stirring at room temperature showed the delinting action was proceeding slowly. The beaker was left undisturbed for 30 minutes at room temperature. An individual seed was then examined showing the lint was easily removed from the seed by abrasion.

EXAMPLE 10

One hundred grams of liquid containing 80% sulfuric acid, 6% by weight preferred foaming agent of ethoxylated alcohol and amide admixed in the ratio of 3:2 and 14% water were foamed. This 100 grams of liquid product produced about 1800 ccs of foam. A portion of the resultant foam was added to undelinted cottonseed in the proportion of 15 grams of sulfuric acid per pound of seed. The beaker of seed and foam was warmed in an oven at 140° F. and stirred for about 10 minutes causing degradation of the cellulose and delinting of the cottonseed.

I claim:

1. A product for use in the process of delinting of cottonseed consisting essentially of a mixture of sulfuric acid having a concentration of 40% or more $H_2SO_4$ and a foaming agent stable to sulfuric acid in sufficient quantity to produce a stable foam, said foaming agent being a fatty amide which is a reaction product of an amine and a coconut product selected from the group consisting of coconut fatty acid and coconut oil.

2. The product defined in claim 1 wherein said amine is diethanolamine.

3. The product defined in claim 2 wherein the molar ratio of said coconut product to said diethanolamine is from about 1:1 to about 1:2.4.

4. The product defined in claim 3 wherein said reaction product is produced by an alkaline catalyst.

5. The product defined in claim 4 wherein said catalyst is potassium hydroxide.

6. The product defined in claim 1 wherein said foaming agent constitutes, by weight, from about 0.12% to about 20% of said mixture.

7. The product defined in claim 1 wherein said foaming agent and said sulfuric acid are admixed and comingled with a gas to produce lather.

8. The product defined in claim 1 wherein said foaming agent also includes a second reaction product of alcohol and ethylene oxide, the ratio by weight in said second reaction product being from about 30 parts to about 45 parts alcohol and about 55 parts to about 70 parts ethylene oxide.

9. The product defined in claim 8 including a gas in sufficient quantity to produce with said mixture a lather having a volume of at least five times the volume of said mixture prior to its being admixed with the gas.

10. The product defined in claim 9 wherein said gas is selected from the group consisting of air, carbon dioxide and nitrogen.

11. The product defined in claim 1 wherein said foaming agent includes ethoxylated alcohol having 8 to 18 carbon atoms and being a reaction product from a mixture of from about 30% to about 45% by weight alcohol having 8 to 18 carbon atoms and from about 55% to about 70% by weight ethylene oxide.

12. The product defined in claim 11 wherein said alcohol contains from ten to twelve carbon atoms and the ratio of said mixture contains from about 7 to about 12 moles of ethylene oxide per mole of alcohol.

13. The product defined in claim 12 wherein said mixture is in admixture with at least 5 volumes of gas selected from the group consisting of air, carbon dioxide and nitrogen.

* * * * *